US011786909B2

(12) United States Patent
Nickels

(10) Patent No.: US 11,786,909 B2
(45) Date of Patent: Oct. 17, 2023

(54) SYSTEMS FOR PROVIDING CENTRIFUGAL MACHINES WITH GRINDING FUNCTIONALITY

(71) Applicant: 11559010 CANADA INC., Hamilton (CA)

(72) Inventor: Christopher Walter Nickels, Toronto (CA)

( * ) Notice: Subject to any disclaimer, the term of this patent is extended or adjusted under 35 U.S.C. 154(b) by 0 days.

(21) Appl. No.: 18/064,693

(22) Filed: Dec. 12, 2022

(65) Prior Publication Data

US 2023/0107564 A1 Apr. 6, 2023

Related U.S. Application Data

(63) Continuation of application No. PCT/CA2021/051618, filed on Nov. 16, 2021.

(60) Provisional application No. 63/240,678, filed on Sep. 3, 2021, provisional application No. 63/114,671, filed on Nov. 17, 2020.

(51) Int. Cl.
*B02C 17/08* (2006.01)
*B02C 17/20* (2006.01)

(52) U.S. Cl.
CPC ..... *B02C 17/08* (2013.01); *B02C 17/20* (2013.01)

(58) Field of Classification Search
CPC ..... B02C 17/18; B02C 17/08; B02C 17/20
See application file for complete search history.

(56) References Cited

U.S. PATENT DOCUMENTS 554,802 A 2/1896 Thomson
569,828 A * 10/1896 Herzfeld ..... B02C 17/18 241/137
2,165,287 A * 7/1939 McBride ..... B02C 17/18 514/504
2,323,544 A * 7/1943 Kiesskalt ..... B02C 17/14 241/137
3,027,105 A * 3/1962 Hall ..... B02C 17/20 451/328

(Continued)

FOREIGN PATENT DOCUMENTS

EP 0233978 B1 2/1990

OTHER PUBLICATIONS

International application No. PCT/CA2021/051618 International Search Report dated Mar. 14, 2022.

(Continued)

*Primary Examiner* — Faye Francis

(57) ABSTRACT

A method of adapting a centrifugal machine that is a dual asymmetric centrifugal mixer or a planetary mill, used for mixing materials, for grinding one or more materials; it includes positioning in a container of the machine, non-spherical grinding media, and securing a lid on the opening of the container, wherein the bases of the units of the non-spherical grinding media are prevented from toppling by having a shortest distance between the center of mass of the unit of non-spherical grinding media and a base be less than half of the width of the base; or securing the lid sufficiently near the top of the units of the non-spherical grinding media such that when a unit of the non-spherical grinding media tilts, the unit of the non-spherical grinding media contacts the lid, the lid acting as an obstacle preventing the unit of the non-spherical grinding media from toppling.

8 Claims, 13 Drawing Sheets

(56) References Cited

U.S. PATENT DOCUMENTS

| | | | | | |
|---|---|---|---|---|---|
| 3,390,867 | A * | 7/1968 | Hagelucken | B01F 29/401 | 451/328 |
| 5,205,499 | A * | 4/1993 | Gamblin | B02C 17/18 | 241/137 |
| 5,733,173 | A * | 3/1998 | Whittle | B02C 17/14 | 451/328 |
| 6,070,817 | A * | 6/2000 | Yanase | B02C 17/20 | 241/179 |
| 6,126,097 | A * | 10/2000 | Chen | B02C 17/24 | 241/176 |
| 7,448,566 | B2 | 11/2008 | Bysouth | | |
| 9,199,241 | B2 * | 12/2015 | Bodurov | B02C 17/20 | |
| 9,724,702 | B2 * | 8/2017 | Uematsu | C08L 5/08 | |
| 2009/0218426 | A1 * | 9/2009 | Wu | B02C 17/14 | 241/176 |

OTHER PUBLICATIONS

International application No. PCT/CA2021/051618 Search Strategy dated Mar. 14, 2022.

International application No. PCT/CA2021/051618 Written Opinion of the International Searching Authority dated Mar. 14, 2022.

* cited by examiner

SYSTEMS FOR PROVIDING CENTRIFUGAL MACHINES WITH GRINDING FUNCTIONALITY

The present application is a U.S. bypass continuation patent application of PCT/CA2021/051618 filed on Nov. 16, 2021, claiming priority from U.S. provisional patent application No. 63/114,671 filed on Nov. 17, 2020, incorporated herein by reference, and U.S. provisional patent application No. 63/240,678, filed on Sep. 3, 2021, incorporated herein by reference.

TECHNICAL FIELD

The present disclosure relates to centrifugal machines, and more particularly to dual asymmetric centrifugal mixers.

BACKGROUND

Dual asymmetric centrifugal mixers have traditionally been used for mixing materials in any physical form, such as, powders, pastes, creams, liquids, gels, such that the sample following mixing is homogeneous. An exemplary dual asymmetric centrifugal mixer is the FlackTek SPEEDMIXER™. However, these mixers have not previously possessed the capacity to reliably and consistently perform comminution such that they can be competitive with other grinding technologies. As such, laboratories and other users requiring both mixing and grinding capabilities have been required to invest in multiple pieces of equipment, that of a machine capable of comminution, such as a shaker, planetary, or other mill, and a machine capable of mixing, such as the FlackTek SPEEDMIXER™. This has been costly and inconvenient for the user, as the user has to purchase multiple pieces of equipment.

As such, there would be an advantage in providing a solution to enable both mixing and grinding in a dual asymmetric centrifugal mixer, or simply to use a dual asymmetric centrifugal mixer for grinding.

SUMMARY

The present disclosure relates to solutions for adapting a dual asymmetric centrifugal mixer, traditionally used for mixing materials, to perform efficient, reliable, and reproducible comminution of solid materials.

The present disclosure pertains to the substitution of spherical grinding media for non-spherical grinding media into the container of the dual asymmetric centrifugal mixer (or a protective shell or wall placed in the container of the dual asymmetric centrifugal mixer to prevent damage to the container), where the units of the non-spherical grinding media have a base for contacting the base of the container of the dual asymmetric centrifugal mixer. As a centrifugal force is applied to the container by the dual asymmetric centrifugal mixer, the non-spherical grinding media are dimensioned to retain an orientation such that a plane defined by their base remains substantially parallel (e.g. within a tolerance of 0 degrees to 30 degrees) with a plane defined by the base of the container, the units of non-spherical grinding media not toppling over. It will be understood by the skilled person that when the term "parallel" is used, this includes a degree of tolerance (e.g. within a tolerance of 0 degrees to 30 degrees), as the grinding media and the base may not be perfectly parallel as the grinding media move around under the centrifugal force.

Although planetary mills and dual asymmetric centrifugal mixers have similar operating principals, the orientation of the centrifugal forces present in a dual asymmetric centrifugal mixer with respect to the container during normal operation differ from those of a planetary mill. As such, the use of spherical grinding media, as are traditionally utilized in a planetary mill, do not yield consistent or robust grinding results when paired with a dual asymmetric centrifugal mixer, instead most often leading to only partial grinding and large particle size distributions. Similar to in a planetary mill, in a dual asymmetric centrifugal mixer a container rotates eccentrically around a central axis, while the container spins on its own axis in the opposite direction. However, in this case the two planes of rotation are not parallel as they are in a planetary mill but instead form an angle. It is this difference in the orientation of the container and acceleration within the container which leads to the compaction of materials under the downforce of spherical media, often leading to partially ground materials, limiting efficacy of spherical media, and ultimately thus far, limiting success in the application of grinding in a dual asymmetric centrifugal mixer.

This method of using non-spherical grinding media rather than spherical grinding media not only allows for grinding in a dual asymmetric centrifuge, but in fact provides a number of improvements over the incumbent grinding technologies which use spherical grinding media, including a reduction in the amount of heat produced during grinding, allowing for larger starting particle sizes of the material to be ground, and allowing for the ability to fine tune the ratio of frictional to impact forces imparted to the sample by adjusting the geometry of the non-spherical grinding media.

In order to enable a sufficient number of relevant collisions such that the sample is effectively ground, it is necessary that each unit of the non-spherical grinding media be maintained in an orientation where its base remains in a parallel position to that of the base of the container under the applied centrifugal forces of the mixer. This results in the base of the non-spherical grinding media sliding along the base of the container under the applied centrifugal forces of the machine. As such, the non-spherical grinding media move in a consistent and reliable manner along the base of the container as the material to be ground vortexes around, and is trapped between them, ensuring that collisions between the units of grinding media and between units of grinding media and the wall of the container are impactful.

It is crucial to the grinding success that the orientation of the units of grinding media be maintained in a position where their base remains parallel to that of the base of the container and that the units of media do not topple when subject to the centrifugal force applied by the dual asymmetric centrifugal mixer. If the grinding media topples such that the base of the non spherical grinding media no longer remains consistently parallel to the base of the jar throughout the grinding process, the result is a partially ground sample with a large particle size distribution. For instance, when non-spherical grinding media are used with a shortest distance between the center of mass and a base that is equal to or greater than half of the width of the base, this can cause instability and ultimately lead to toppling of the units of grinding media.

In some examples, the units of grinding media are prevented from toppling by being dimensioned such that the shortest distance between the center of mass of the unit of grinding media and the base of the unit of grinding media is less than half of the width of the base. The shortest distance may also be represented by the segment that is orthogonal with the base of the unit of grinding media further defined by the point representing the center of mass of the unit of grinding media.

In some examples, the width of the unit of grinding media is greater than that of its height, such that the units of grinding media are most stable in, and have a preferred orientation where their base remains parallel to the base of the container when the centrifugal force is applied by the machine.

In some examples, the units of grinding media are prevented from toppling by having a lid, for covering the opening of the container, positioned sufficiently close to the top of the units of grinding media such that the lid acts as a barrier when the units of grinding media tilt, thereby preventing the units of grinding media from toppling. The lid may also be used in a planetary mill, when non-spherical grinding media are used.

The shapes of the grinding media may vary, provided that the grinding media are non-spherical. For instance, in some examples, the grinding media may be cylindrical, annular, prismatic, gear-shaped, etc. The grinding media may be hollow or solid.

In some examples, the grinding media may be symmetric with respect to an axis running along its center, parallel with its height. In some examples, the grinding media may be symmetric with respect to a plane, parallel to the base of the unit of grinding media, intersecting the unit of grinding media at a position that is equidistant from the top and base of the unit of grinding media.

In some examples, the grinding media may be asymmetric.

A broad aspect is a method of adapting a dual asymmetric centrifugal mixer for grinding one or more materials. The method includes positioning in a container of the dual asymmetric centrifugal mixer, through an opening of the container, where the container is adapted to be subject to centrifugal force applied by the dual asymmetric centrifugal mixer, one or more units of non-spherical grinding media, wherein the one or more units of the non-spherical grinding media have a base for contacting a base of the container and a top opposite from the base; and securing a lid on the opening of the container, wherein the one or more units of the non-spherical grinding media are prevented from toppling, where, once fallen over, a plane defined by a contact surface of the base of the fallen unit of the non-spherical grinding media is no longer parallel with a plane defined by the base of the receptacle by at least one of having a shortest distance between a center of mass of a unit of the one or more units of non-spherical grinding media and a base of the unit of the one or more units of non-spherical grinding media be less than half of the width of the base of the unit of the one or more units of non-spherical grinding media; and securing the lid sufficiently near the top of the one or more units of the non-spherical grinding media to prevent a tilting unit of the one or more units of non-spherical grinding media from toppling, the tilting unit of the non-spherical grinding media contacting the lid, the lid acting as an obstacle to the toppling, whereby the one or more materials to be ground is added to the receptacle, and the one or more units of non-spherical grinding media grind the one or more materials when the container is subject to the centrifugal force applied by the dual asymmetric centrifugal mixer.

In some embodiments, the one or more units of the non-spherical grinding media may be prevented from toppling by the having a shortest distance between the center of mass of a unit of the one or more units of non-spherical grinding media and a base of the unit of the one or more units of non-spherical grinding media being less than half of the width of the base of the unit of the one or more units of the non-spherical grinding media.

In some embodiments, the height of the unit of one or more units of the non-spherical grinding media may be less than the width of the base of the unit of the one or more units of non-spherical grinding media.

In some embodiments, the one or more units of non-spherical grinding media may have chamfered edges.

In some embodiments, the one or more units of the non-spherical grinding media may be prevented from toppling by securing the lid sufficiently near the top of the one or more units of the non-spherical grinding media to prevent a tilting non-spherical grinding media from toppling, the tilting unit of the non-spherical grinding media contacting the lid, the lid acting as an obstacle to the toppling.

In some embodiments, the one or more units of the non-spherical grinding media may have a hollow interior.

In some embodiments, the one or more units of the non-spherical grinding media may have a solid interior.

In some embodiments, the one or more units of the non-spherical grinding media may have a cylindrical shape.

In some embodiments, the one or more units of the non-spherical grinding media may have a prism shape.

In some embodiments, the one or more units of the non-spherical grinding media may be rings with different diameters.

In some embodiments, the container and the one or more units of non-spherical grinding media may be made from the same material.

Another broad aspect is a method of grinding one or more materials using a dual asymmetric centrifugal mixer. The method includes adding one or more units of non-spherical grinding media to a container for use with the dual asymmetric centrifugal mixer; adding the one or more materials to be ground to the container; placing a lid on the container containing the one or more units of non-spherical grinding media and the one or more materials and wherein the one or more units of the non-spherical grinding media are prevented from toppling, where, once fallen over, a plane defined by a contact surface of the base of the fallen unit of the non-spherical grinding media is no longer parallel with a plane defined by the base of the container, by at least one of having a shortest distance between a center of mass of a unit of the one or more units of non-spherical grinding media and a base of the unit of the one or more units of non-spherical grinding media be less than half of the width of the base of the unit of the one or more units of non-spherical grinding media; and securing the lid sufficiently near the top of the one or more units of the non-spherical grinding media to prevent a tilting of a unit of the one or more non-spherical grinding media from toppling, the tilting unit of the non-spherical grinding media contacting the lid, the lid acting as an obstacle to the toppling; and applying a centrifugal force to the container through the mixer, where the centrifugal force results in the one or more units of non-spherical grinding media colliding with the one or more materials, reducing the size of pieces of the one or more materials.

In some embodiments, the one or more units of the non-spherical grinding media may be prevented from toppling by the having a shortest distance between center of mass of a unit of the one or more units of non-spherical grinding media and a base of the unit of one or more units of the non-spherical grinding media be less than half of the width of the base of the unit of the one or more units of non-spherical grinding media.

In some embodiments, the one or more units of non-spherical grinding media may have a width of the base that is greater than a height of the one or more units of the non-spherical grinding media.

In some embodiments, the one or more units of the non-spherical grinding media may be prevented from toppling by the securing the lid sufficiently near the top of the one or more units of the non-spherical grinding media to prevent a tilting non-spherical grinding media from toppling, the tilting unit of the non-spherical grinding media contacting the lid, the lid acting as an obstacle to the toppling.

Another broad aspect is grinding media for adapting a dual asymmetric centrifugal mixer for grinding one or more materials contained in a container of the dual asymmetric centrifugal mixer, wherein the grinding media are non-spherical units, and wherein a unit of the grinding media comprises a base defining a width and a top opposite the base, wherein the shortest distance between the center of mass of the unit and the base of the unit is less than half of the width of the base of the unit, whereby the grinding media is to be added to the container that is adapted to be subject to a centrifugal force applied by the dual asymmetric centrifugal mixer causing the grinding media to grind the one or more materials.

In some embodiments, the grinding media may be shaped as solid cylinders, hollow cylinders, solid prisms, hollow prisms, or rings with different diameters.

In some embodiments, the grinding media may include chamfered edges.

Another broad aspect is a kit for adapting a planetary mill or dual asymmetric centrifugal mixer, manufactured for grinding one or more materials contained in a container of the planetary mill or dual asymmetric centrifugal mixer. The kit includes one or more units of non-spherical grinding media having a base and a top opposite the base for adding to the container through an opening of the container; and a lid that is configured to be secured sufficiently near the top of the one or more units of the non-spherical grinding media to prevent a tilting unit of the one or more units of non-spherical grinding media from toppling, the tilting unit of the non-spherical grinding media contacting the lid, the lid acting as an obstacle to the toppling.

Another broad aspect is a planetary mill comprising the kit as described herein.

Another broad aspect is a dual asymmetric centrifugal mixer comprising the grinding media as described herein or the kit as described herein.

Another broad aspect is a method of grinding one or more materials using a planetary mill. The method includes adding one or more units of non-spherical grinding media to a container for use with the planetary mill; adding the one or more materials to be ground to the container; placing a lid on the container containing the one or more units of non-spherical grinding media and the one or more materials and wherein the one or more units of the non-spherical grinding media are prevented from toppling, where, once fallen over, a plane defined by a contact surface of the base of the fallen unit of the non-spherical grinding media is no longer parallel with a plane defined by the base of the container by securing the lid sufficiently near the top of the one or more units of the non-spherical grinding media to prevent a tilting unit of the one or more units of non-spherical grinding media from toppling, the tilting unit of the non-spherical grinding media contacting the lid, the lid acting as an obstacle to the toppling; and applying a centrifugal force to the container through the planetary mill, where the centrifugal force results in the one or more units of non-spherical grinding media colliding with the one or more materials, reducing the size of the pieces of the one or more materials.

Another broad aspect is a method of adapting a dual asymmetric centrifugal mixer for grinding one or more materials while mixing with the dual asymmetric centrifugal mixer. The method includes adding to a container of the dual asymmetric centrifugal mixer, where the container is adapted to be subject to centrifugal force applied by the dual asymmetric centrifugal mixer, non-spherical grinding media; adding the one or more materials to the container; and grinding the one or more materials using the centrifugal mixer and the non-spherical grinding media, wherein a central unit of non-spherical grinding media is surrounded by non-central units of non-spherical grinding media and wherein a number of units of non-central non-spherical grinding media is sufficient to prevent the central unit of grinding media from touching a wall of the container, the non-central non-spherical units of grinding media moving around the central unit of non-spherical grinding media between a wall of the container and the central non-spherical unit of grinding media, resulting in collisions between the non-spherical grinding media, while preventing the non-spherical grinding media from toppling over due to contact between the non-spherical grinding media and the wall of the container.

In some embodiments, a height of a unit of the non-spherical grinding media may be greater than a base of the unit of the non-spherical grinding media.

In some embodiments, the non-spherical grinding media may be cylindrical.

In some embodiments, the non-spherical grinding media may be prisms.

In some embodiments, the non-spherical grinding may be rings.

In some embodiments, the non-spherical grinding media may have a hollow center.

In some embodiments, the non-spherical grinding media may include chamfered edges.

In some embodiments, the non-spherical grinding media may be of different dimensions.

In some embodiments, the central unit of non-spherical grinding media may have a greater diameter than the non-central units of non-spherical grinding media.

In some embodiments, the non-spherical grinding media may include feet at a base of the non-spherical grinding media that elevate the non-spherical grinding media from a base of the container, for allowing the one or more materials to circulate between the base of the non-spherical grinding media and the base of the container.

Another broad aspect is a method of adapting a dual asymmetric centrifugal mixer for grinding one or more materials. The method includes adding to a container of the dual asymmetric centrifugal mixer, where the container is adapted to be subject to centrifugal force applied by the dual asymmetric centrifugal mixer, one or more ring-shaped units of non-spherical grinding media; adding the one or more materials to the container; and grinding the one or more materials using the dual asymmetric centrifugal mixer and the one or more ring-shaped units of non-spherical grinding media.

In some embodiments, the one or more ring-shaped units of non-spherical grinding media may contain slots at a base for allowing the one or more materials to pass under the ring-shaped non-spherical grinding media during mixing.

In some embodiments, the one or more ring-shaped units of non-spherical grinding media may include a plurality of non-spherical grinding media, wherein the plurality of ring-shaped units of non-spherical grinding media may be added to the container such that they are concentric.

In some embodiments, the one or more ring-shaped units of non-spherical grinding media may include a plurality of non-spherical grinding media, wherein the plurality of ring-shaped non-spherical grinding media may be of different dimensions.

Another broad aspect is a container adapted for use in a dual asymmetric centrifugal mixer for use in grinding one or more materials with the dual asymmetric centrifugal mixer. The container includes an inner wall shaped as a cylindrical shell with a first diameter; an outer wall shaped as a cylindrical shell with a second diameter, wherein the first diameter is less than the second diameter, and wherein the inner wall and the outer wall and a base of the container define a compartment for receiving non-spherical grinding media and the one or more materials to be ground.

In some embodiments, the inner wall defines a hollow center piece.

In some embodiments, the inner wall defines a solid center piece.

Another broad aspect is a kit including the container as defined herein, and grinding media for adapting a dual asymmetric centrifugal mixer for grinding one or more materials contained in the container, wherein the grinding media are non-spherical units, and wherein a unit of the grinding media comprises a base defining a width and a top opposite the base.

Another broad aspect is a method of adapting a dual asymmetric centrifugal mixer for grinding one or more materials. The method includes adding to a compartment of a container of the dual asymmetric centrifugal mixer, wherein the container is adapted to be subject to centrifugal force applied by the dual asymmetric centrifugal mixer, and wherein the container includes an inner wall and an outer-wall defining a ring-shaped base for the container, the inner wall, outer wall and ring-shaped base defining the compartment, one or more units of non-spherical grinding media, whereby the one or more materials are added to the container for grinding the one or more materials using the dual asymmetric centrifugal mixer and a unit of the one or more units of non-spherical grinding media that are prevented from falling over due to at least two of the inner wall, the outer wall and other units of the one or more units.

Another broad aspect is a lid for a container used in a dual asymmetric centrifugal mixer for use in grinding one or more materials with a dual asymmetric centrifugal mixer. The lid includes a flat disk-shaped cover portion for sealing the container; and a protrusion extending from the flat cover portion and centered with respect to the flat disk-shaped cover portion, wherein the protrusion is adapted to fit into the container when the cover portion is positioned over an opening of the container, wherein the protrusion is adapted to define with the wall of the container a compartment for receiving non-spherical grinding media, the non-spherical grinding media travelling in the defined space when the dual asymmetric centrifugal mixer is mixing.

In some embodiments, a length of the protrusion may be configured to span the height of the container.

In some embodiments, the protrusion may have a cylindrical shape.

Another broad aspect is non-spherical grinding media for grinding one or more materials using a dual asymmetric centrifugal mixer. The non-spherical media includes one or more rings acting as grinding media when added to a container, with the one or more materials, of the dual asymmetric centrifugal mixer while mixing with the dual asymmetric centrifugal mixer.

In some embodiments, the one or more rings may include a plurality of rings.

In some embodiments, the rings of the plurality of rings may be concentric.

In some embodiments, the one or more rings may include feet.

In some embodiments, the one or more rings may include slots for allowing the one or more materials to flow through the slots during the grinding.

Another broad aspect is a method of adapting a dual asymmetric centrifugal mixer for grinding one or more materials. The method includes positioning in a container of the dual asymmetric centrifugal mixer, through an opening of the container, where the container is adapted to be subject to centrifugal force applied by the dual asymmetric centrifugal mixer, one or more units of non-spherical grinding media, wherein the one or more units of the non-spherical grinding media have a base for contacting a base of the container and a top opposite from the base; and securing a lid on the opening of the container, wherein the one or more units of the non-spherical grinding media are prevented from toppling, where, once fallen over, a plane defined by a contact surface of the base of the fallen unit of the non-spherical grinding media is no longer parallel with a plane defined by the base of the container, by at least one of securing the lid sufficiently near the top of the one or more units of the non-spherical grinding media to prevent a tilting unit of the one or more units of non-spherical grinding media from toppling, the tilting unit of the non-spherical grinding media contacting the lid, the lid acting as an obstacle to the toppling; and having a shortest distance between a center of mass of a unit of the one or more units of non-spherical grinding media and a base of the unit of the one or more units of non-spherical grinding media be less than half of a width of the base of the unit of the one or more units of non-spherical grinding media, whereby the one or more materials to be ground is added to the container, and the one or more units of non-spherical grinding media grind the one or more materials when the container is subject to the centrifugal force applied by the dual asymmetric centrifugal mixer.

In some embodiments, the one or more units of the non-spherical grinding media may be prevented from toppling by the securing the lid sufficiently near the top of the one or more units of the non-spherical grinding media to prevent a tilting non-spherical grinding media from toppling, the tilting unit of the non-spherical grinding media contacting the lid, the lid acting as an obstacle to the toppling.

In some embodiments, the one or more units of the non-spherical grinding media may be prevented from toppling by the having a shortest distance between the center of mass of a unit of the one or more units of non-spherical grinding media and a base of the unit of the one or more units of non-spherical grinding media being less than half of the width of the base of the unit of the one or more units of the non-spherical grinding media.

In some embodiments, the height of the unit of one or more units of the non-spherical grinding media may be less than the width of the base of the unit of the one or more units of non-spherical grinding media.

In some embodiments, the one or more units of non-spherical grinding media may have at least one of chamfered edges and fillet edges.

In some embodiments, the one or more units of the non-spherical grinding media may have a hollow interior.

In some embodiments, the one or more units of the non-spherical grinding media may have a solid interior.

In some embodiments, the one or more units of the non-spherical grinding media may have a cylindrical shape.

In some embodiments, the one or more units of the non-spherical grinding media may have a prism shape.

In some embodiments, the one or more units of the non-spherical grinding media may be rings with different diameters.

In some embodiments, the container and the one or more units of non-spherical grinding media may be made from the same material.

Another broad aspect is method of grinding one or more materials using a dual asymmetric centrifugal mixer. The method includes adding one or more units of non-spherical grinding media to a container for use with the dual asymmetric centrifugal mixer; adding the one or more materials to be ground to the container; placing a lid on the container containing the one or more units of non-spherical grinding media and the one or more materials and wherein the one or more units of the non-spherical grinding media are prevented from toppling, where, once fallen over, a plane defined by a contact surface of the base of the fallen unit of the non-spherical grinding media is no longer parallel with a plane defined by the base of the container, by at least one of having a shortest distance between a center of mass of a unit of the one or more units of non-spherical grinding media and a base of the unit of the one or more units of non-spherical grinding media be less than half of a width of the base of the unit of the one or more units of non-spherical grinding media; and securing the lid sufficiently near the top of the one or more units of the non-spherical grinding media to prevent a tilting unit of the one or more units of non-spherical grinding media from toppling, the tilting unit of the non-spherical grinding media contacting the lid, the lid acting as an obstacle to the toppling; and applying a centrifugal force to the container through the mixer, where the centrifugal force results in the one or more units of non-spherical grinding media colliding with the one or more materials, reducing the size of pieces of the one or more materials.

In some embodiments, the one or more units of the non-spherical grinding media may be prevented from toppling by the having a shortest distance between the center of mass of a unit of the one or more units of non-spherical grinding media and a base of the unit of one or more units of the non-spherical grinding media be less than half of the width of the base of the unit of the one or more units of non-spherical grinding media.

In some embodiments, the one or more units of non-spherical grinding media may have a width of the base that is greater than a height of the one or more units of the non-spherical grinding media.

In some embodiments, the one or more units of the non-spherical grinding media may be prevented from toppling by the securing the lid sufficiently near the top of the one or more units of the non-spherical grinding media to prevent a tilting non-spherical grinding media from toppling, the tilting unit of the non-spherical grinding media contacting the lid, the lid acting as an obstacle to the toppling.

Another broad aspect is grinding media for adapting a dual asymmetric centrifugal mixer for grinding one or more materials contained in a container of the dual asymmetric centrifugal mixer, wherein the grinding media are non-spherical units, and wherein a unit of the grinding media comprises a base defining a width and a top opposite the base, wherein a shortest distance between a center of mass of the unit and the base of the unit is less than half of a width of the base of the unit, whereby the grinding media is to be added to the container that is adapted to be subject to a centrifugal force applied by the dual asymmetric centrifugal mixer causing the grinding media to grind the one or more materials.

In some embodiments, the grinding media may be shaped as solid cylinders, hollow cylinders, solid prisms, hollow prisms, or rings with different diameters.

In some embodiments, the grinding media may include at least one of chamfered edges and fillet edges.

Another broad aspect is a kit for adapting a planetary mill or dual asymmetric centrifugal mixer, manufactured for grinding one or more materials contained in a container of the planetary mill or dual asymmetric centrifugal mixer. The kit includes one or more units of non-spherical grinding media having a base and a top opposite the base for adding to the container through an opening of the container; and a lid that is configured to be secured sufficiently near the top of the one or more units of the non-spherical grinding media to prevent a tilting unit of the one or more units of non-spherical grinding media from toppling, the tilting unit of the non-spherical grinding media contacting the lid, the lid acting as an obstacle to the toppling.

Another broad aspect is a planetary mill including the kit as defined herein.

Another broad aspect is a dual asymmetric centrifugal mixer comprising the grinding media as defined herein or the kit as defined herein.

Another broad aspect is a method of grinding one or more materials using a planetary mill. The method includes adding one or more units of non-spherical grinding media to a container for use with the planetary mill; adding the one or more materials to be ground to the container; placing a lid on the container containing the one or more units of non-spherical grinding media and the one or more materials and wherein the one or more units of the non-spherical grinding media are prevented from toppling, where, once fallen over, a plane defined by a contact surface of the base of the fallen unit of the non-spherical grinding media is no longer parallel with a plane defined by the base of the container by securing the lid sufficiently near the top of the one or more units of the non-spherical grinding media to prevent a tilting unit of the one or more units of non-spherical grinding media from toppling, the tilting unit of the non-spherical grinding media contacting the lid, the lid acting as an obstacle to the toppling; and applying a centrifugal force to the container through the planetary mill, where the centrifugal force results in the one or more units of non-spherical grinding media colliding with the one or more materials, reducing the size of pieces of the one or more materials.

Another broad aspect is a method of adapting a dual asymmetric centrifugal mixer for grinding one or more materials while mixing with the dual asymmetric centrifugal mixer. The method includes adding to a container of the dual asymmetric centrifugal mixer, where the container is adapted to be subject to centrifugal force applied by the dual asymmetric centrifugal mixer, non-spherical grinding media; adding the one or more materials to the container; and grinding the one or more materials using the centrifugal mixer and the non-spherical grinding media, wherein a central unit of non-spherical grinding media is surrounded by non-central units of non-spherical grinding media and wherein a number of units of non-central non-spherical grinding media is sufficient to prevent the central unit of grinding media from touching a wall of the container, the non-central non-spherical units of grinding media moving around the central unit of non-spherical grinding media between a wall of the container and the central non-spherical unit of grinding media, resulting in collisions between the non-spherical grinding media, while preventing the non-spherical grinding media from toppling over due to contact between the non-spherical grinding media and the wall of the container.

In some embodiments, a height of a unit of the non-spherical grinding media may be greater than a base of the unit of the non-spherical grinding media.

In some embodiments, the non-spherical grinding media may be cylindrical or prisms.

In some embodiments, the non-spherical grinding may be rings.

In some embodiments, the non-spherical grinding media may include at least one of chamfered edges and fillet edges.

In some embodiments, the non-spherical grinding media may be of different dimensions.

In some embodiments, the central unit of non-spherical grinding media may have a greater diameter than the non-central units of non-spherical grinding media.

In some embodiments, the non-spherical grinding media may include feet at a base of the non-spherical grinding media that elevate the non-spherical grinding media from a base of the container, for allowing the one or more materials to circulate between the base of the non-spherical grinding media and the base of the container.

Another broad aspect is a method of adapting a dual asymmetric centrifugal mixer for grinding one or more materials. The method includes adding to a container of the dual asymmetric centrifugal mixer, where the container is adapted to be subject to centrifugal force applied by the dual asymmetric centrifugal mixer, one or more ring-shaped units of non-spherical grinding media; adding the one or more materials to the container; and grinding the one or more materials using the dual asymmetric centrifugal mixer and the one or more ring-shaped units of non-spherical grinding media.

In some embodiments, the one or more ring-shaped units of non-spherical grinding media may contain slots at a base for allowing the one or more materials to pass under the ring-shaped non-spherical grinding media during mixing.

In some embodiments, the one or more ring-shaped units of non-spherical grinding media may include a plurality of non-spherical grinding media, wherein the plurality of ring-shaped units of non-spherical grinding media are added to the container such that they are concentric.

In some embodiments, the one or more ring-shaped units of non-spherical grinding media may include a plurality of non-spherical grinding media, wherein the plurality of ring-shaped non-spherical grinding media are of different dimensions.

Another broad aspect is a container adapted for use in a dual asymmetric centrifugal mixer for use in grinding one or more materials with the dual asymmetric centrifugal mixer. The container includes an inner wall shaped as a cylindrical shell with a first diameter; an outer wall shaped as a cylindrical shell with a second diameter, wherein the first diameter is less than the second diameter, and wherein the inner wall and the outer wall and a base of the container define a compartment for receiving non-spherical grinding media and the one or more materials to be ground.

In some embodiments, the inner wall may define a hollow center piece.

In some embodiments, the inner wall may define a solid center piece.

In some embodiments, the height of the inner wall may be less than the height of the outer wall.

In some embodiments, the inner wall may form a bump.

Another broad aspect is a kit. The kit includes the container as defined herein, and grinding media for adapting a dual asymmetric centrifugal mixer for grinding one or more materials contained in the container, wherein the grinding media are non-spherical units, and wherein a unit of the grinding media comprises a base defining a width and a top opposite the base.

Another broad aspect is a method of adapting a dual asymmetric centrifugal mixer for grinding one or more materials. The method includes adding to a compartment of a container of the dual asymmetric centrifugal mixer, wherein the container is adapted to be subject to centrifugal force applied by the dual asymmetric centrifugal mixer, and wherein the container includes an inner wall and an outer wall defining a ring-shaped base for the container, the inner wall, outer wall and ring-shaped base defining the compartment, one or more units of non-spherical grinding media, whereby the one or more materials are added to the container for grinding the one or more materials using the dual asymmetric centrifugal mixer and a unit of the one or more units of non-spherical grinding media that are prevented from falling over due to at least two of the inner wall, the outer wall and other units of the one or more units.

Another broad aspect is a lid for a container used in a dual asymmetric centrifugal mixer for use in grinding one or more materials with a dual asymmetric centrifugal mixer. The lid includes a flat disk-shaped cover portion for sealing the container; and a protrusion extending from the flat cover portion, wherein the protrusion is adapted to fit into the container when the cover portion is positioned over an opening of the container, wherein the protrusion is adapted to define with the wall of the container a compartment for receiving non-spherical grinding media, the non-spherical grinding media travelling in the defined space when the dual asymmetric centrifugal mixer is mixing.

In some embodiments, the protrusion may have a cylindrical shape.

Another broad aspect is a kit comprising the container and the lid as defined herein.

In some embodiments, a length of the protrusion may be configured to span the height of the container.

In some embodiments, a length of the protrusion may be less than the height of the container.

Another broad aspect is non-spherical grinding media for grinding one or more materials using a dual asymmetric centrifugal mixer. The non-spherical grinding media includes one or more rings acting as grinding media when added to a container, with the one or more materials, of the dual asymmetric centrifugal mixer while mixing with the dual asymmetric centrifugal mixer.

In some embodiments, the one or more rings may include a plurality of rings.

In some embodiments, the rings of the plurality of rings may be concentric.

In some embodiments, the one or more rings may include feet.

In some embodiments, the one or more rings may include slots for allowing the one or more materials to flow through the slots during the grinding.

BRIEF DESCRIPTION OF THE DRAWINGS

The invention will be better understood by way of the following detailed description of embodiments of the invention with reference to the appended drawings, in which.

DETAILED DESCRIPTION

Figure 1A:
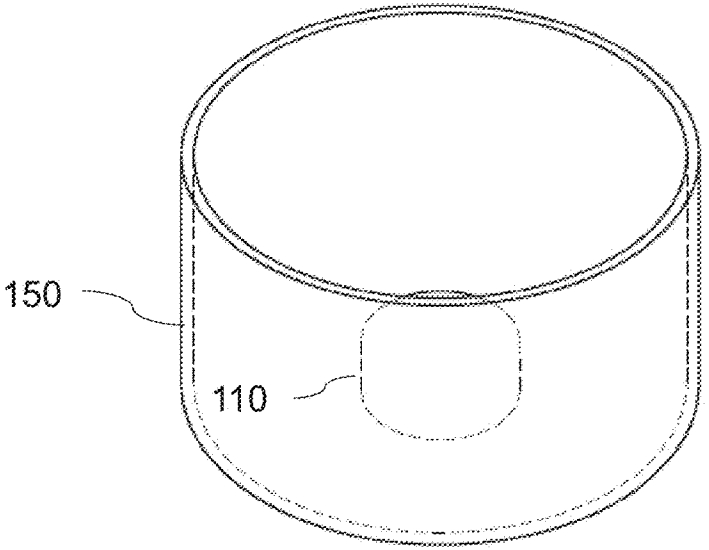
FIG. 1A is a drawing of a perspective view of an exemplary container with an exemplary unit of grinding media.

The present disclosure relates to adapting a dual asymmetric centrifugal mixer to allow the mixer to grind down granules of one or more materials found in the container of the machine.

As such, the dual asymmetric centrifugal mixer may be primarily used for grinding.

The dual asymmetric centrifugal mixer is adapted for grinding by adding non-spherical grinding media with a base (e.g. flat base) to the container of the dual asymmetric centrifugal mixer. When the centrifugal force is applied to the container by the dual asymmetric centrifugal mixer, the grinding media are maintained in an orientation where the base of the units of grinding media remain parallel to the base of the container of the dual asymmetric centrifugal mixer.

The units of grinding media are prevented from toppling in order to improve collisions between the units of grinding media and units of grinding media and the wall of the container and the force applied to the granules of material, which break the granules into smaller particles.

In some embodiments, the units of grinding media are prevented from toppling onto their side by having units of grinding media which are dimensioned such that the shortest distance between the center of mass of the unit of grinding media and the base of the unit of grinding media is less than half of the width of the base.

In some embodiments, the units of non-spherical grinding media are dimensioned such that the width is greater than that of the height, such that the units of grinding media are most stable, and have a preferred orientation where their base remains parallel to the base of the container when the centrifugal force is applied by the machine.

In some embodiments, the units of grinding media are prevented from toppling onto their side by having a lid that is positioned near the top of the units of grinding media, such that the lid acts as a barrier if the unit of grinding media tilts over. Contact between the lid and the unit of grinding media prevents the unit of grinding media from toppling.

In some embodiments, the units of grinding media are prevented from toppling onto their side by having a container that has a donut shaped compartment for receiving the grinding media, the compartment defined between a center piece and an outer wall.

Definitions

In the present disclosure, by "container", it is meant the vessel (e.g. jar) in which the one or more materials and the grinding media are added. The container is then positioned in the dual asymmetric centrifugal mixer. The container is subject to a centrifugal force exerted by the dual asymmetric centrifugal mixer. In some embodiments, the container may be joined to a planetary mill.

In the present disclosure, by "dual asymmetric centrifugal mixer", it is meant a machine that rotates an angled container eccentrically around a central axis, while the container spins on its own axis in the opposite direction. By "angled container", it is meant that the two planes of rotation are not parallel, but instead form an angle. Exemplary dual asymmetric centrifugal mixers include, but are not limited to, the FlackTek SpeedMixer™, the THINKY™ mixer, the MAZ™ mixer, etc.

In the present disclosure, by "grinding media", it is meant objects added to the container of the dual asymmetric centrifugal mixer to cause the grinding of the one or more materials through collisions between the units of grinding media, or grinding media and the wall of the container, where the granules of one or more materials are trapped between the colliding units of grinding media and/or the units of grinding media and the wall of the container, where the collision energy causes the granules to break up into smaller parts.

In the present disclosure, by "one or more materials", it is meant the one or more materials that are added to the container of the dual asymmetric centrifugal mixer that are to be ground. These may be any range or combination of materials including but not limited to ores, pharmaceuticals, plastics, pigments, agricultural products, etc. where it is necessary to reduce the average particle size of the sample. It may also include chemical reagents for the purpose of carrying out a mechanochemical reaction.

In the present disclosure, by "planetary mill", it is meant a centrifugal machine where a container rotates eccentrically around a central axis, while the container spins on its own axis in the opposite direction in such a way that both planes of rotation are parallel.

In the present disclosure, by "toppling", it is meant to become unsteady and fall. In the case of units of grinding media, when a unit of grinding media topples, the unit of grinding changes orientation, resulting in a different orientation from those that have not toppled (e.g. toppled units of grinding media may remain positioned on their side, where units of grinding media that have not toppled may remain positioned on their base).

Figure 1B:
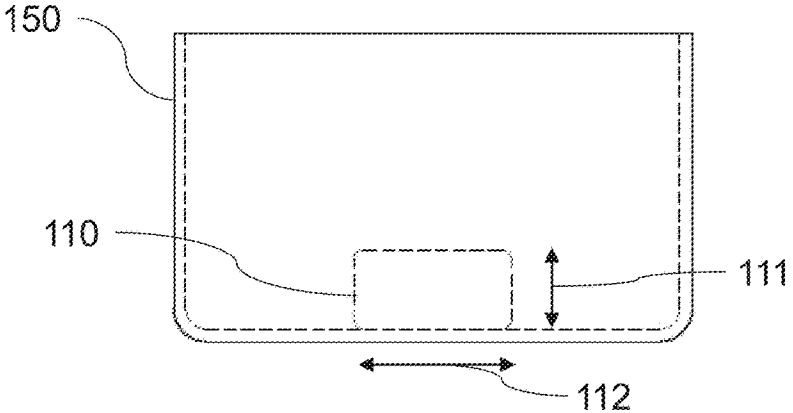
FIG. 1B is a drawing of a cross-sectional front view of an exemplary container with an exemplary unit of grinding media.

Exemplary Container with a Unit of Grinding Media:

Reference is now made to FIGS. 1A and 1B, illustrating an exemplary container 150 for use with a dual asymmetric centrifugal mixer, the exemplary container 150 containing, for the purpose of illustration, an exemplary unit of grinding media 110. It will be understood that, for grinding, the container 150 may contain a plurality of units of grinding media 110, or simply one unit of grinding media 110 as shown in FIGS. 1A and 1B.

The dimensions of the container 150 may vary depending on the dual asymmetric centrifugal mixer, the required volume, the materials to be ground, etc.

The unit of grinding media 110 has a height 111 and a width 112 (e.g. the diameter of the base of the unit of grinding media 110). The height 111 may be defined as the distance between the contact surface of the base of the unit of grinding media 110 (for being placed on the base of the container 150 as shown in FIG. 1B) and the top of the unit of grinding media 110 that is opposite to the base and may be measured along an axis perpendicular to the base surface of the unit of grinding media. In the examples of grinding media shown in FIGS. 2A-7C, the units of grinding media 110 are resting on their base.

Exemplary Units of Grinding Media:

References is now made to FIGS. 2A-7C, illustrating exemplary units of grinding media.

As shown in FIGS. 2A-7C, the unit of grinding media may have different shapes and/or dimensions.

Figure 3A:
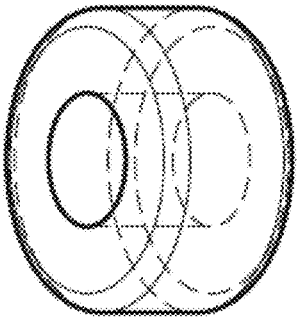
FIG. 3A is a drawing of a perspective view of an exemplary unit of grinding media.
Figure 3B:
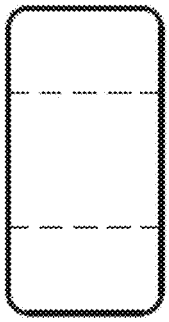
FIG. 3B is a drawing of a front view of the exemplary unit of grinding media of FIG. 3A.
Figure 3C:
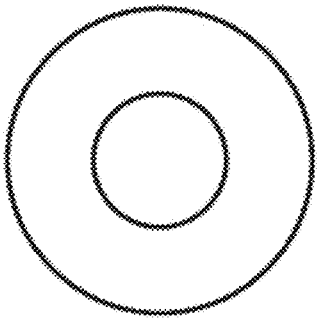
FIG. 3C is a drawing of a top-down view of the exemplary unit of grinding media of FIG. 3A.
Figure 2A:
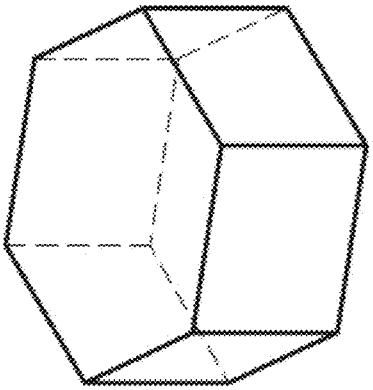
FIG. 2A is a drawing of a perspective view of an exemplary unit of grinding media.
Figure 2B:
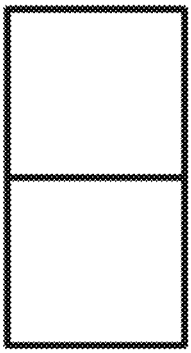
FIG. 2B is a drawing of a front view of the exemplary unit of grinding media of FIG. 2A.
Figure 2C:
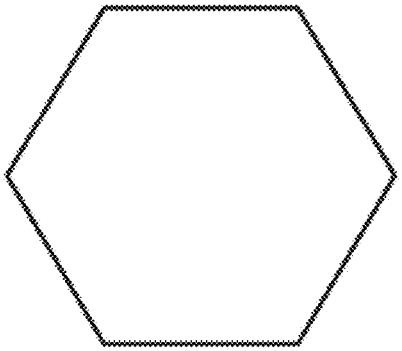
FIG. 2C is a drawing of a top-down view of the exemplary unit of grinding media of FIG. 2A.
Figure 4A:
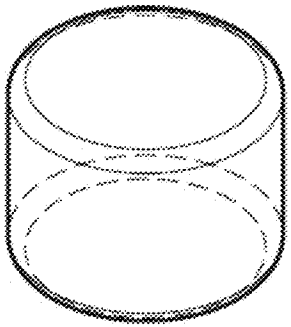
FIG. 4A is a drawing of a perspective view of an exemplary unit of grinding media.
Figure 4B:
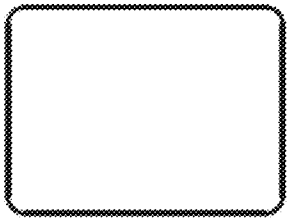
FIG. 4B is a drawing of a front view of the exemplary unit of grinding media of FIG. 4A.
Figure 4C:
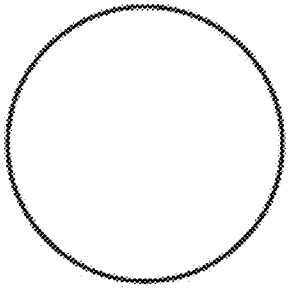
FIG. 4C is a drawing of a top-down view of the exemplary unit of grinding media of FIG. 4A.

For instance, as shown in FIGS. 2A-2C, 6A-6C, 7A-7C, the unit of grinding media may have a prismatic shape (such as a hexagon-base prism). In some examples, the unit of grinding media may have a cylindrical shape (FIGS. 3A-3C; FIGS. 4A-4C).

Figure 5A:
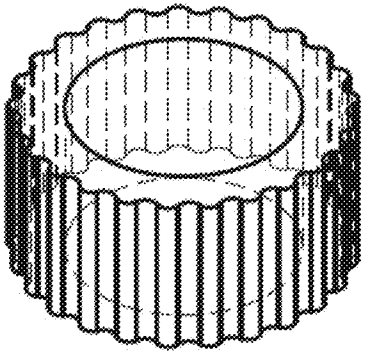
FIG. 5A is a drawing of a perspective view of an exemplary unit of grinding media.
Figure 5B:
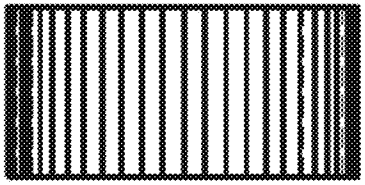
FIG. 5B is a drawing of a front view of the exemplary unit of grinding media of FIG. 5A.
Figure 5C:
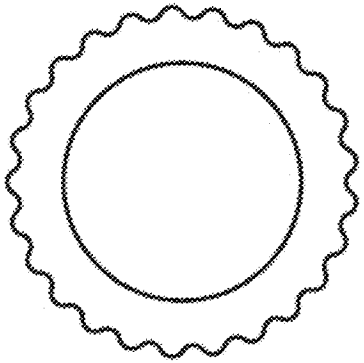
FIG. 5C is a drawing of a top-down view of the exemplary unit of grinding media of FIG. 5A.
Figure 7A:
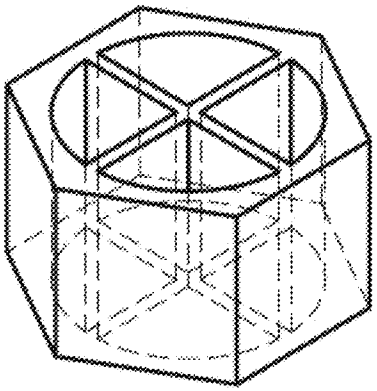
FIG. 7A is a drawing of a perspective view of an exemplary unit of grinding media.
Figure 7B:
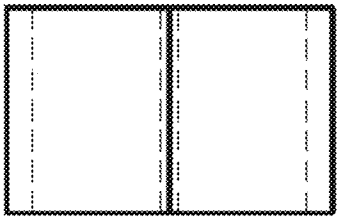
FIG. 7B is a drawing of a front view of the exemplary unit of grinding media of FIG. 7A.
Figure 7C:
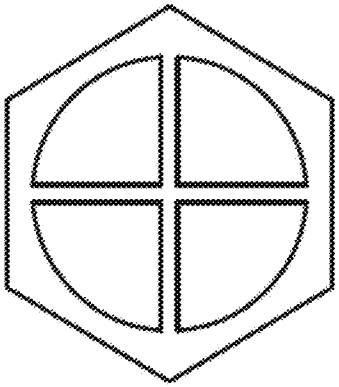
FIG. 7C is a drawing of a top-down view of the exemplary unit of grinding media of FIG. 7A.
Figure 6A:
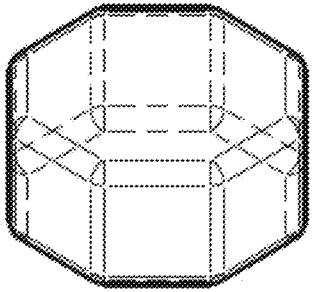
FIG. 6A is a drawing of a perspective view of an exemplary unit of grinding media.
Figure 6B:
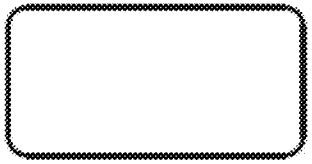
FIG. 6B is a drawing of a front view of the exemplary unit of grinding media of FIG. 6A.
Figure 6C:
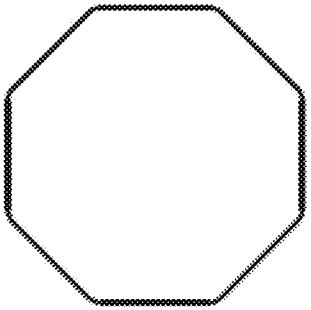
FIG. 6C is a drawing of a top-down view of the exemplary unit of grinding media of FIG. 6A.

The unit of grinding media may be solid (FIGS. 2A-2C, 4A-4C, 6A-6C). The unit of grinding media may be hollow (FIGS. 3A-3C, having a ring or donut shape; FIGS. 5A-5C, with teeth, as with a gear; FIGS. 7A-7C, where the hollow center may have an interior structure or framework, such as intersecting planes as shown in this example).

In some examples, the unit of grinding media 110 may be made from the same material as the container 150, or an inner shell placed within the container 150 for protecting the container 150 from damage and wear caused by the collisions. In preferred embodiments, the unit of grinding media 110 may have the same hardness as the material of the container 150.

The unit of grinding media 110 may have a base for positioning on the base of the container 150. In some examples, the unit of grinding media 110 has a flat top opposite the base. In some examples, the base and/or top of the unit of grinding media may have rounded edges as shown in FIGS. 3A-3C. In some examples, the base of the unit of grinding media 110 may have a slight curvature (not shown).

In some examples, the unit of grinding media 110 may be dimensioned such that the shortest distance between the center of mass of the unit of grinding media and the base of the unit of grinding media is less than half of the width of the base.

In some examples, the unit of grinding media 110 has a width that is greater than its height. In some embodiments, the height of the unit of grinding media may be less than 90% of the width of the unit of grinding media, thereby preventing the unit of grinding media 110 from toppling onto its side when a centrifugal force is applied to the unit of grinding media 110 by the dual asymmetric centrifugal mixer.

In some examples, when a lid 130 is placed over the unit of grinding media 110 sufficiently close to the top of the unit of grinding media to prevent the unit of grinding media from toppling over as explained herein, the height of the unit of grinding media 110 may be equal to its width, or greater than its width.

In some examples, the unit of grinding media 110 may have chamfer edges or soft edges (i.e. a fillet edge) for modifying the collisions between the units of grinding media 110, and/or the unit(s) of grinding media and the wall of the container (e.g. as shown in FIGS. 3A-3C; 4A-4C; 6A-6C).

In some examples, the unit of grinding media 110 may include feet 119 for resting on the base of the container. The feet 119 allow the one or more materials to be ground to circulate under the unit of grinding media 110 (between the base of the container and the base of the unit of griding media 110), for preventing accumulation of the one or more materials during grinding. It will be understood that the number and position of the feet 119 may vary without departing from the present teachings, provided that the number and position of the feet 119 are sufficient for stabilizing the unit of grinding media on its base with the feet 119 when at rest on a flat surface (e.g. 3 feet at 120 degrees from one another, etc.) In some examples, the unit of grinding media 110 may include one or more slots 118 for allowing the one or more materials to be ground to circulate under the unit of grinding media 110. The slots 118 may have an arched shape. The slots 118 may have an angled shape (e.g. forming teeth).

Figure 14A:
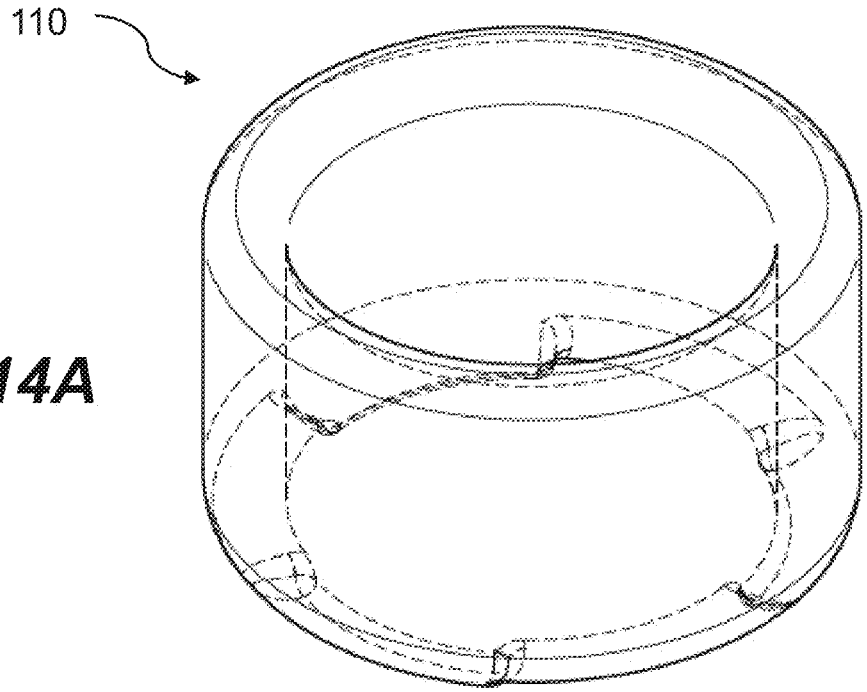
FIG. 14A is a top-down perspective view of an exemplary unit of grinding media shaped as a ring with exemplary slots.
Figure 14B:
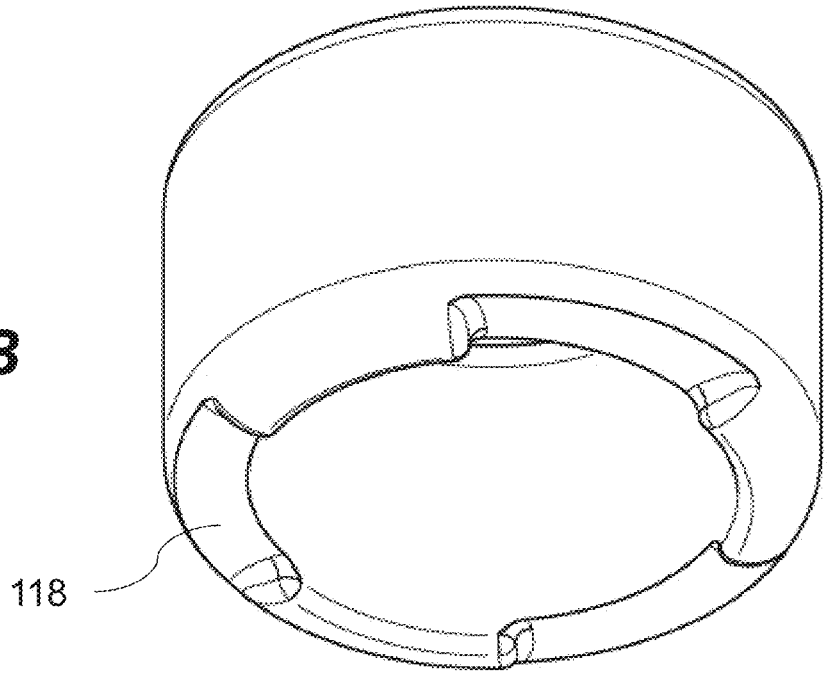
FIG. 14B is a bottom perspective view of an exemplary unit of grinding media shaped as a ring with exemplary slots.
Figure 15A:
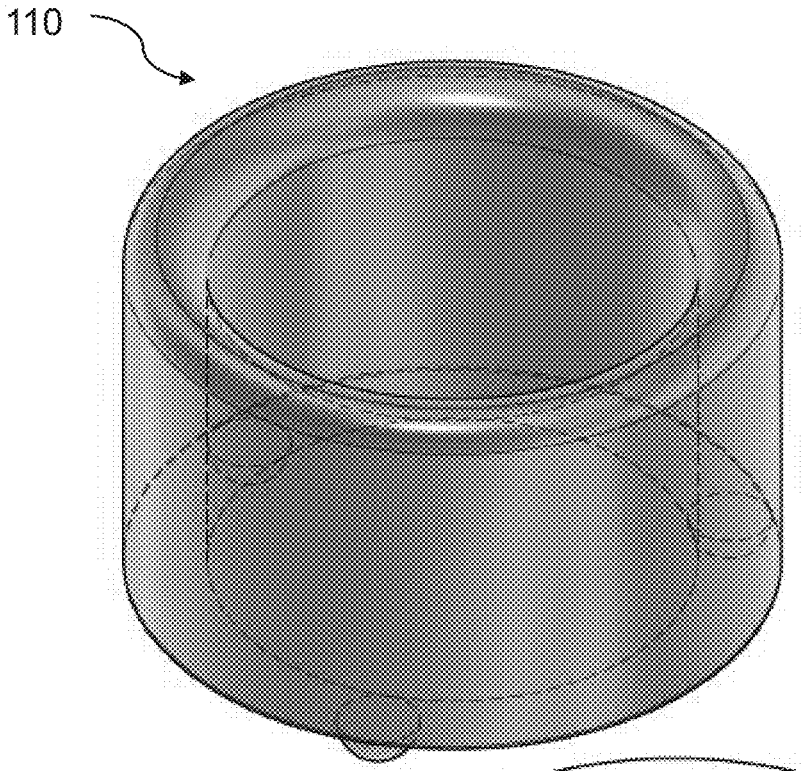
FIG. 15A is a top-down perspective view of an exemplary unit of grinding media shaped as a ring with exemplary feet.
Figure 15B:
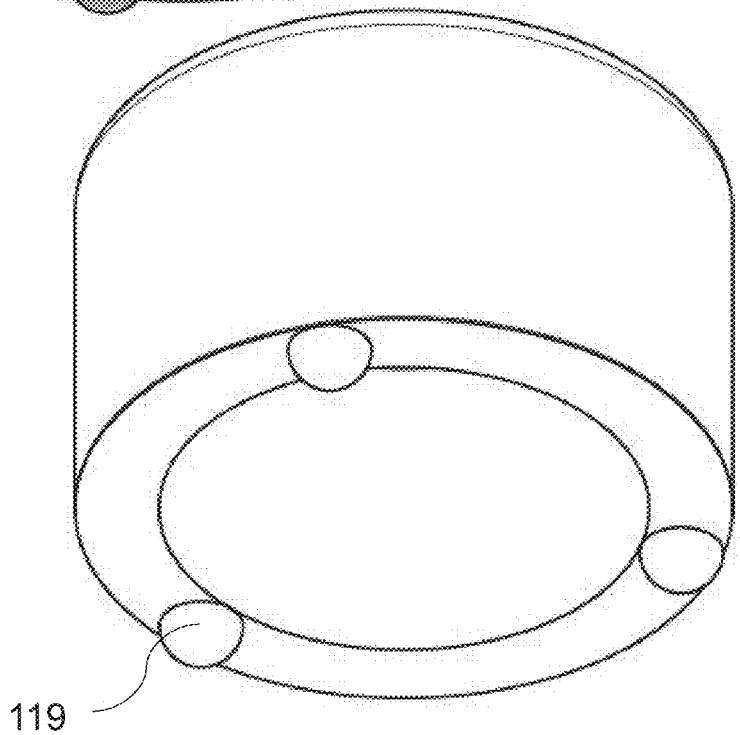
FIG. 15B is a bottom perspective view of an exemplary unit of grinding media shaped as a ring with exemplary feet.

In some examples, the units of grinding media 110 may be shaped as one or more rings, where the one or more rings may be of varying size (e.g. height, width, thickness, etc.) In some examples, the one or more rings may include slots 118 (as shown in FIGS. 14A and 14B) at one or more of the edges for allowing the one or more materials to be ground to circulate under the unit of grinding media 110, for preventing accumulation of the one or more materials during grinding in the hollow center of the ring. In some examples, there may be a plurality of rings. In some examples, the non-spherical grinding media (e.g. the rings) may have feet 119 (as shown in FIGS. 15A and 15B). The rings of varying size may be placed one inside another, concentrically, where grinding contact occurs between the outer surface of one ring and the inner surface of another ring. The edges of the ring may also be chamfered.

It will be understood that in these embodiments where the one or more non-spherical grinding media are shaped as one or more rings the one or more rings may have a height that is greater than the span of the base of the non-spherical grinding media, or have a shortest distance between a center of mass of a unit of the ring and a base of the ring that is more than or equal to half of a width of the base of the ring. The one or more materials to be ground (or as the one or more materials are gradually ground) can provide support for the one or more rings that are set on or in the one or more materials.

Figure 10:
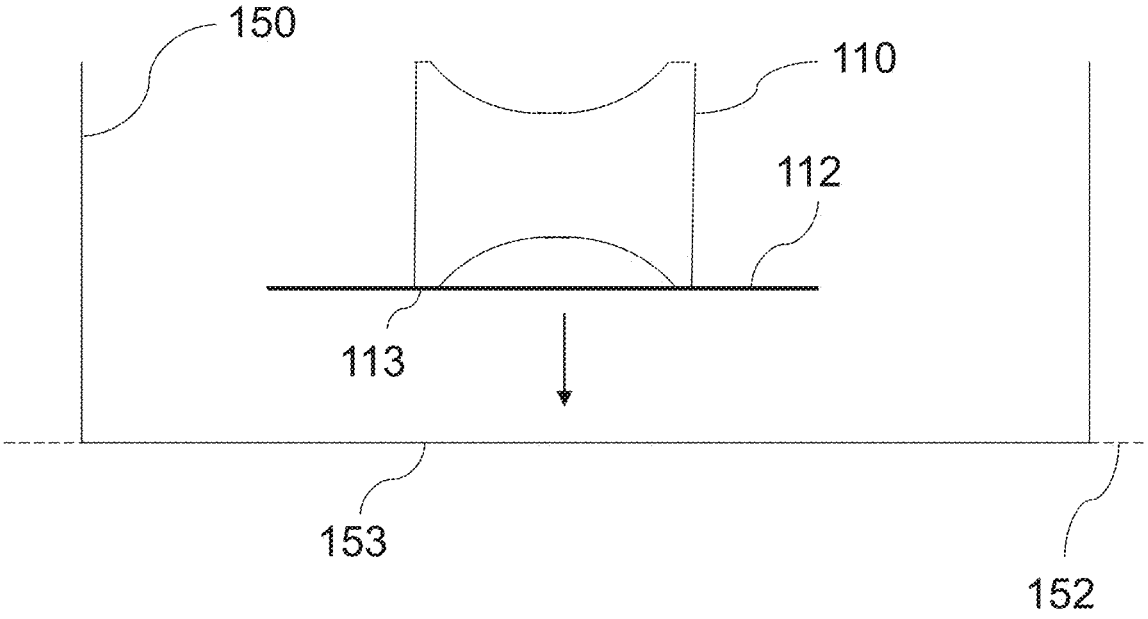
FIG. 10 is a drawing of a cross-sectional exemplary container and exemplary unit of grinding media to be positioned on the base of the container, where a first plane defines a base of the unit of grinding media and a second plane defines a base of the container, the first plane parallel with the second plane.

FIG. 10 shows an exemplary unit of grinding media 110 that is to be positioned on a base 153 of a container 150. The base 113 of the unit of grinding media 110 is to contact the base 153 of the container 150. Even though the bottom portion of the unit of grinding media 110 includes concave walls at its top and bottom portions, the base 113 is defined as the face or portion of the unit of grinding media 110 that contacts the base 153 of the container 150. As shown in FIG. 10, not the entire base 113 has to contact the base 153 of the container 150 (where the concave portion of the base 113 does not contact). In fact, in some embodiments, there may only be an outer ridge of the base 113 that contacts the base 153 of the container 150. The portion of the base 113 that is to contact the base 153 of the container 150 is defined as the contact surface of the base 113. The portion of the base 113 that contacts the base 153 of the container 150 is usually at a same height. The portion of the base 113 that contacts the base 153 of the container 150 corresponds to a plane 112 defined by the points of the base 113 that are adapted to contact the base 153 of the container 150. Similarly, the plane 152 is defined by the surface of the base 153 of the container 150.

In some examples, the shape of the container may be cylindrical, where in other embodiments, the shape of the container may be non-cylindrical, such as prismatic, etc.

Exemplary Container with an Exemplary Lid for Preventing the Units of Grinding Media from Toppling:

Reference is now made to FIG. 8, illustrating an exemplary container 150 with an exemplary lid 130 placed at a sufficient distance from the top of the units of grinding media 110 to prevent the units of grinding media 110 from toppling onto their side when a centrifugal force is applied by the dual asymmetric centrifugal mixer.

Figures 8A, 8B:
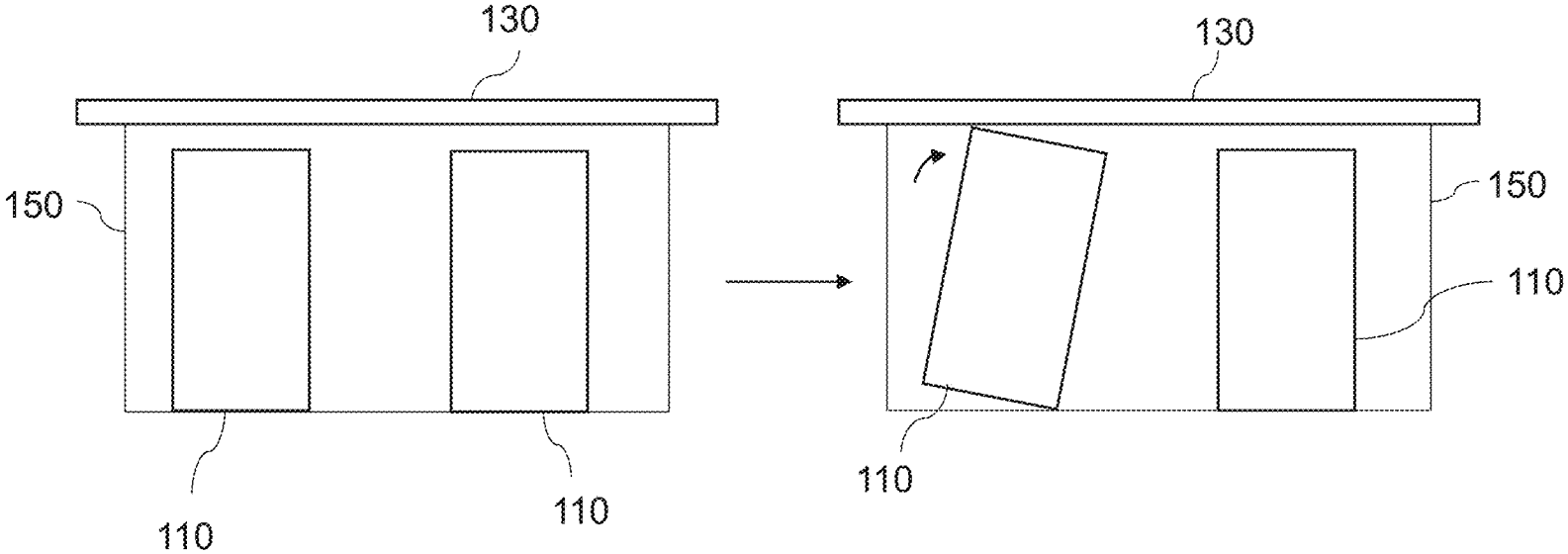
FIG. 8A is a drawing of a cross-sectional view of an exemplary container covered by a lid and containing two units of exemplary grinding media, showing the container where both units of grinding media are contacting the base of the container.
FIG. 8B is a drawing of a cross-sectional view of an exemplary container covered by a lid and containing two units of exemplary grinding media, showing one tilting unit of the grinding media that is about to topple over, but contacts the lid, preventing the unit of grinding media from toppling.

As shown in FIGS. 8A and 8B, the lid 130 is secured over the top of the grinding media 110 sufficiently close to the top of the grinding media 110 when the grinding media 110 are oriented with their base positioned on the base of the container 150.

If a unit of grinding media 110 starts to tilt over, as shown in FIG. 8B, this causes the unit of grinding media 110 to lift up, gaining additional height as it rises on its edge. This rising causes the unit of grinding media 110 to contact the lid 130, forming a ceiling immediately above the unit of grinding media 110. The lid 130 prevents the unit of grinding media 110 from continuing to tilt, and eventually topple onto its side, thereby maintaining the units of grinding media 110 in an orientation where their base contacts the base of the container 150, despite the presence of the centrifugal force caused by the dual asymmetric centrifugal mixer.

In some examples, the lid 130 may be adapted to the size of the grinding media 110 and to the dimensions of the container 150 to fit into the container 150 over the grinding media 110, where there is significant distance between the top of the units of grinding media 110 and the opening of the container 150, where a lid 130 that simply rests over the top of the container 150 would provide too much vertical space and allow for the units of grinding media 110 to topple when a centrifugal force is applied (as shown in the example of FIGS. 1A-1B).

In some examples, the dimensions and height of the container 150 may be such that the height of the container 150 is only slightly greater than the height of the units of grinding media 110, where the lid 130 would rest over the top of the container 150 and over the top of the units of grinding media 110, preventing the units of grinding media 110 from toppling as explained herein.

The lid 130 may be a screw-top, a lever-lock, snap-top etc.

The use of the lid 130 to prevent the toppling of the grinding media 110 may also be used in a planetary mill when the planetary mill uses non-spherical grinding media for comminution.

Figure 11A:
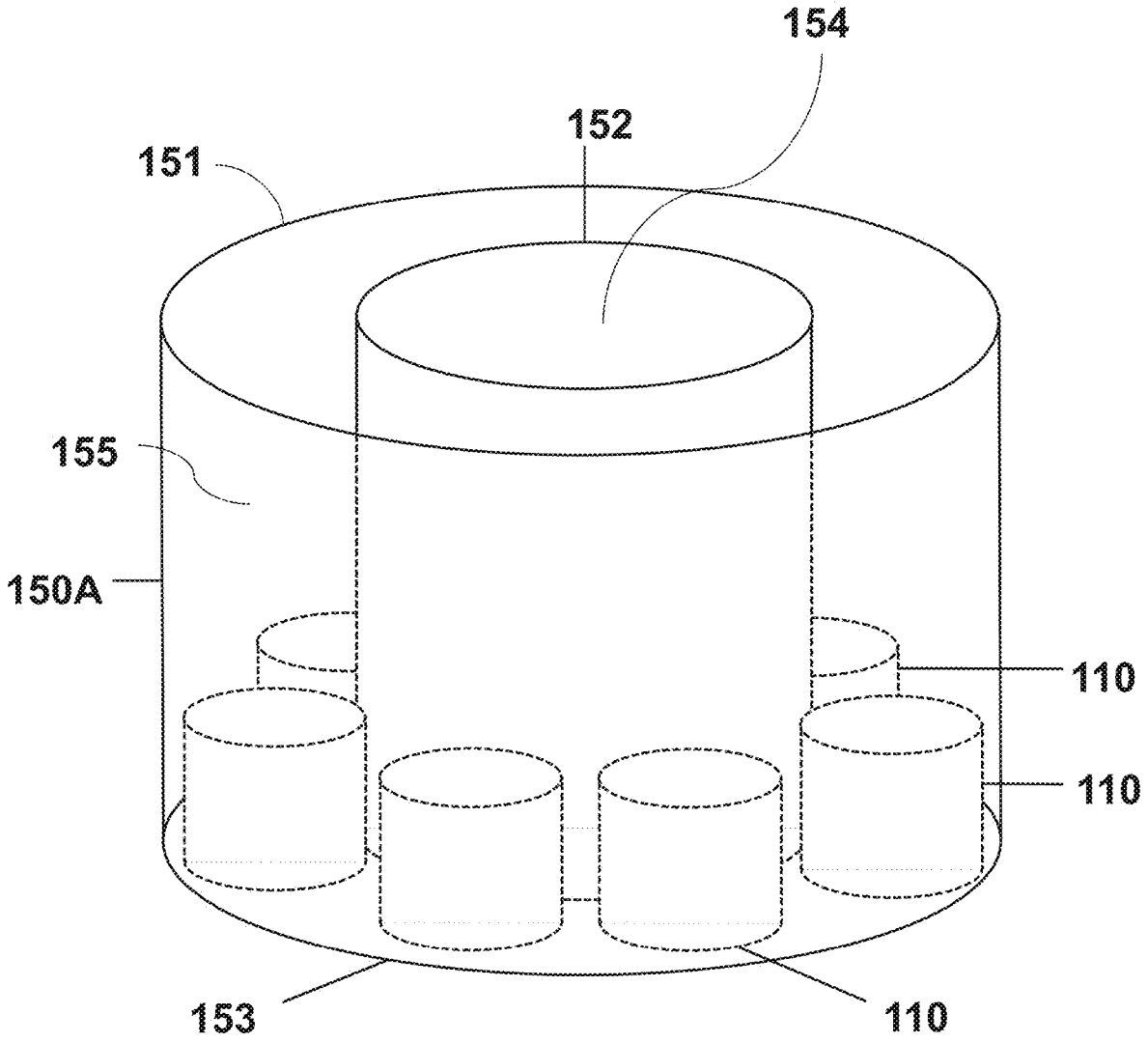
FIG. 11A is a drawing of an exemplary hollow-cylindrical-shaped container, defining a space for receiving grinding media.

Exemplary Hollow-Cylinder-Shaped Container for Receiving Grinding Media:

Reference is now made to FIG. 11A, illustrating an exemplary container 150A for receiving grinding media 110 and one or more materials to be ground, for use with a dual asymmetric centrifugal mixer.

The container 150A contains an inner wall 152 shaped as a cylindrical wall and an outer wall 151 shaped as a cylinder shell. The cylinder shell of the outer wall 151 has a diameter that is greater than the diameter of cylinder of the inner wall 152. The center piece 154 defined by the inner wall 152 may be hollow or solid, at the middle of the container 150A. The inner wall 152, the outer wall 151 and the base 153 of the container 150A define a compartment 155 for receiving the griding media 110 and the one or more materials to be ground. The outer wall 151 and the base 153 may define the shape of the base (e.g. a ring-like shape). It will be understood that the height of the inner wall 152 does not have to be equivalent to the height of the outer wall 151, wherein the height of the wall is sufficient to prevent the grinding media 110 from toppling (e.g. equal to or greater than the height of the center of mass of a unit of grinding media 110).

In some examples, the inner wall 152 may form an abutment (e.g. a protrusion, a bump) that impedes movement of the grinding media 110, when the lid 130 is placed over the grinding media. In some examples, the container 150A may have an inner wall 152 and the lid 130A may have a protrusion 132 (e.g. where the outer wall of protrusion 132 aligns with the inner wall 152).

The grinding media 110 is positioned in the compartment 155. It will be understood that in these embodiments that the non-spherical grinding media may have a height that is greater than the span of the base of the non-spherical grinding media, or have a shortest distance between a center of mass of a unit of non-spherical grinding media and a base of the unit of non-spherical grinding media be more than or equal to half of a width of the base of the unit of non-spherical grinding media.

Figure 11B:
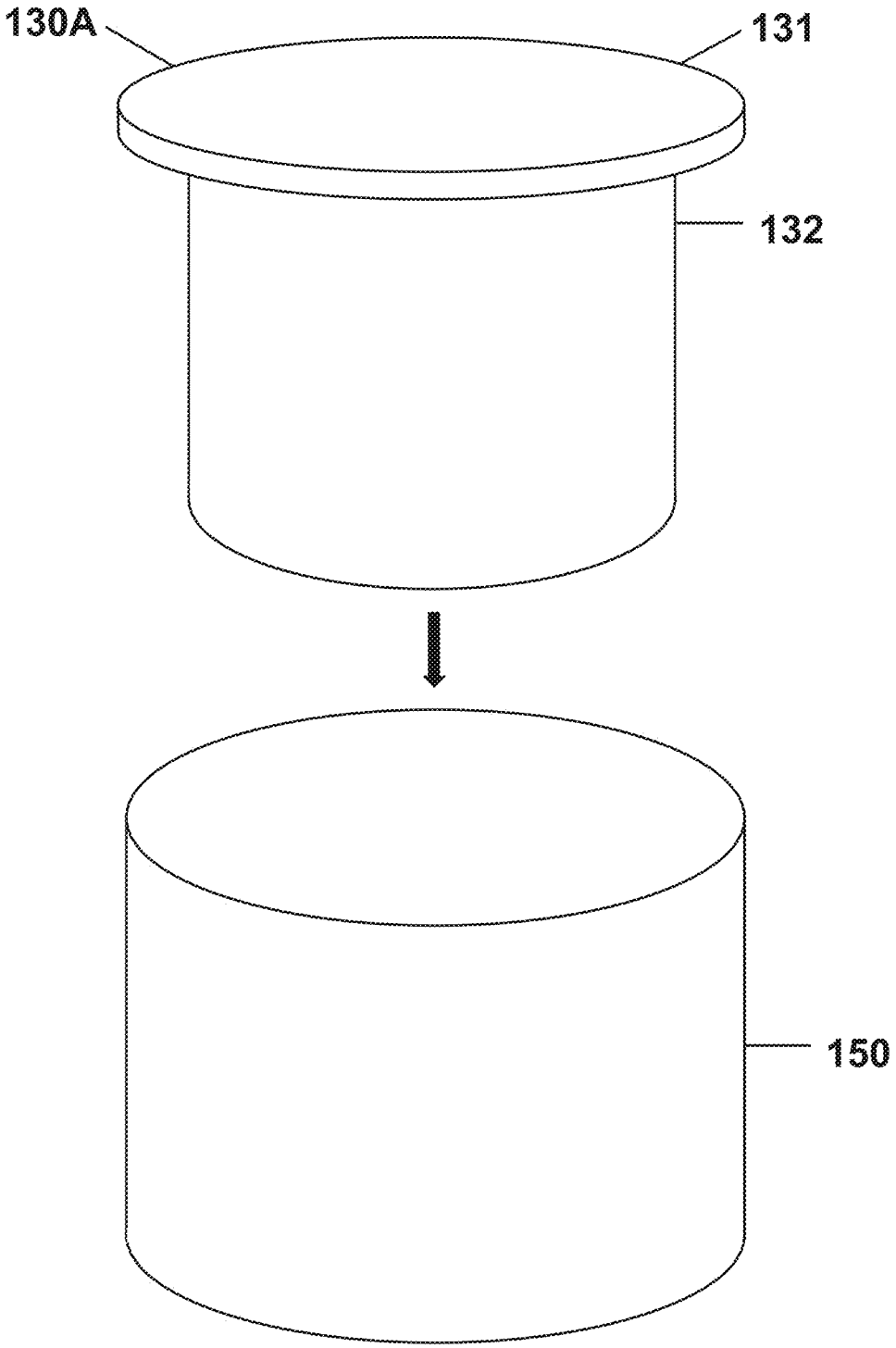
FIG. 11B is a drawing of an exemplary lid for an exemplary container to cover an opening of an exemplary container for grinding one or more materials using a dual asymmetric centrifugal mixer.

In other embodiments, the container 150 may not be a hollow cylinder, instead being shaped as a container as in FIG. 11B. In these embodiments, the container 150 may have a lid 130A including a base portion 131 and a protrusion 132 extending from the base portion 131. In some examples, the protrusion 132 may be cylindrical. In some examples, the protrusion 132 may be shaped as a polygon and/or include a concave or convex top (not shown), or a bump. When the lid 130A is positioned over the container 150, sealing the opening of the container 150, the sides of the protrusion 132 and the wall of the container 152 define a compartment of a hollow-cylindrical shape for receiving the grinding media and the one or more materials. Toppling of the grinding media 110 is reduced by being positioned between the surface of the protrusion 132 and the wall of the container 150. Moreover, the grinding media 110 is positioned in the compartment defined by the protrusion 132 and the wall of the container 150.

In some examples, the height of the protrusion 132 may be equal to the height of the container 150. In some examples, the height of the protrusion 132 may be less than the height of the container 150 in order to allow materials to be ground to pass between the top of the protrusion 132 and the base of the container 150, but sufficient to provide support for the sides of the grinding media 110.

It will be understood that in these embodiments that the non-spherical grinding media may have a height that is greater than the span of the base of the non-spherical grinding media, or have a shortest distance between a center of mass of a unit of non-spherical grinding media and a base of the unit of non-spherical grinding media be more than or equal to half of a width of the base of the unit of non-spherical grinding media.

Figure 9:
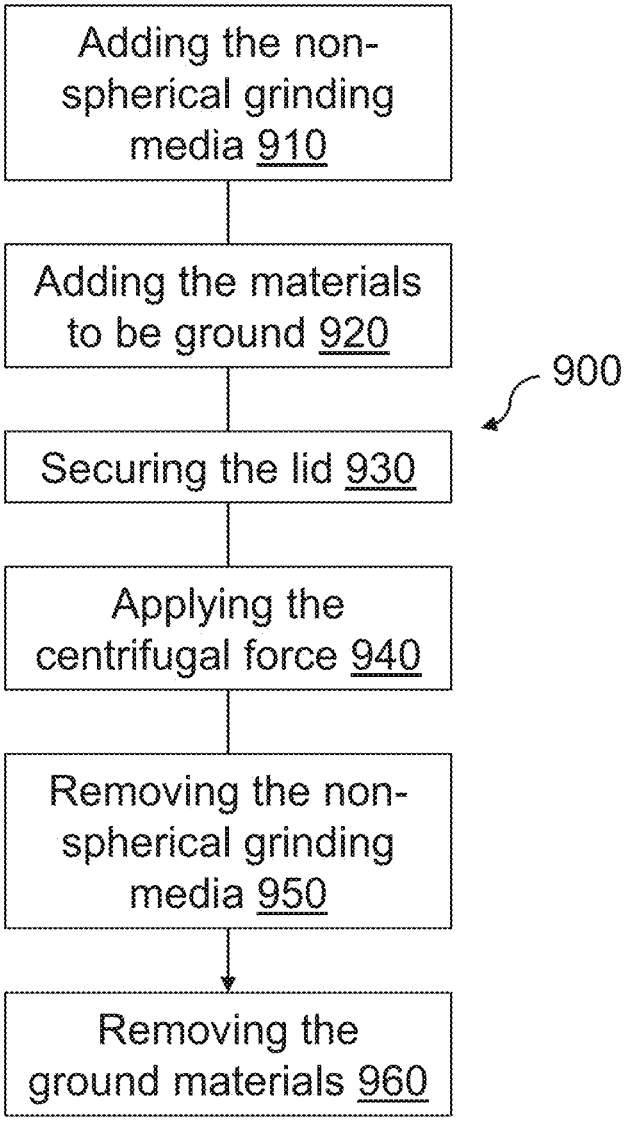
FIG. 9 is a flowchart diagram of an exemplary method of grinding materials using a dual asymmetric centrifugal mixer.

Exemplary Method of Grinding Materials Using a Dual Asymmetric Centrifugal Mixer:

Reference is now made to FIG. 9, illustrating an exemplary method 900 of grinding one or more materials (e.g. grinding wet materials, dry materials, slurries, pastes, etc.) using a dual asymmetric centrifugal mixer. Reference is made to grinding media 110, container 150 and lid 130 for illustrative purposes. However, it would be understood that any other grinding media, container and/or lid may be used in accordance with the present teachings.

One or more units of non-spherical grinding media 110 are added to the container 150 of the dual asymmetric centrifugal mixer, through the opening of the container 130 at step 910. The one or more units of non-spherical grinding media 110 may be positioned on their base such that all of the one or more units of non-spherical grinding media 110 have the same orientation, where the units of non-spherical grinding media 110 do not topple. The one or more units of non-spherical grinding media 110 may also self-orient into their more stable orientation (e.g. their base contacting the base of the container) when the centrifugal force is applied by the dual asymmetric centrifugal mixer.

The one or more materials to be ground are added to the container 150, through the opening of the container, at step 920. The one or more materials may be granules of a certain size, where the size of the granules is to be reduced through the process of grinding (e.g. down to a powder). The order of steps 910 and 920 is interchangeable.

A lid 130 may be secured to seal the opening of the container 150 at step 930. In some embodiments, the lid 130 is secured to the container 150 at a position over the top of the one or more units of griding media 110 such that, when the one or more units of grinding media 110 start to tilt, and temporarily gain height as they tilt and rest on their edge, the one or more units of grinding media 110 contact the lid 130, the lid 130 acting as a barrier preventing the one or more units of grinding media 110 from toppling. The example of the lid 130 acting as a barrier for the grinding media 110 may also be used for a planetary mill, when the grinding media used in the planetary mill are non-spherical.

Figure 13:
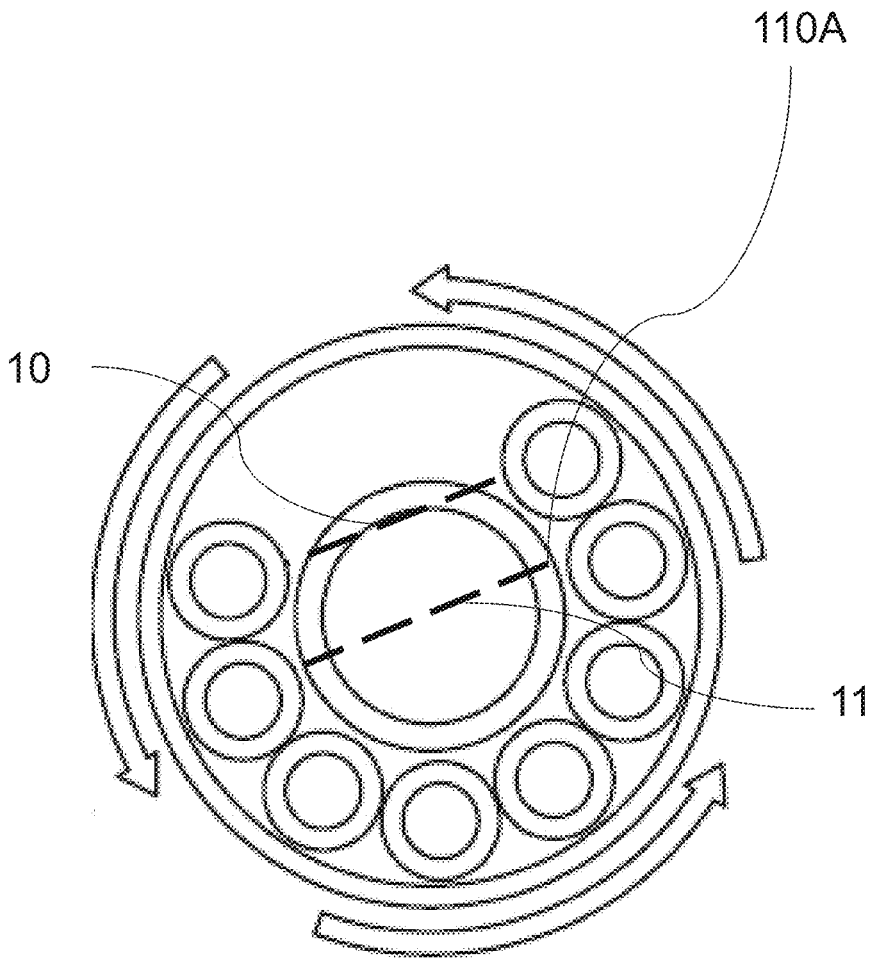
FIG. 13 is a drawing of an exemplary container with an exemplary central unit of grinding media and exemplary non-central units of grinding media, where the central unit of grinding media has a greater width than the non-central units of grinding media.

In some embodiments, instead of or in addition to using a lid 130, one unit of non-spherical grinding media may be present at a center of the base of the container (e.g. move to the center when the dual asymmetric centrifugal mixer is mixing), where the other units of non-spherical grinding media circulate around the central unit of grinding media during the grinding process. In some embodiments, the central unit of grinding media may be the same (e.g. same dimensions) as the other units of grinding media that circulate around the central unit of grinding media. In some embodiments, the central unit of grinding media may be of a different size from the other units of grinding media, as shown in FIG. 13 illustrating the larger stabilizing unit of grinding media 110A. The non-spherical grinding media may have a height that is greater than the span of the base of the non-spherical grinding media, or have a shortest distance between a center of mass of a unit of non-spherical grinding media and a base of the unit of non-spherical grinding media be more than or equal to half of a width of the base of the unit of non-spherical grinding media.

Figure 12:
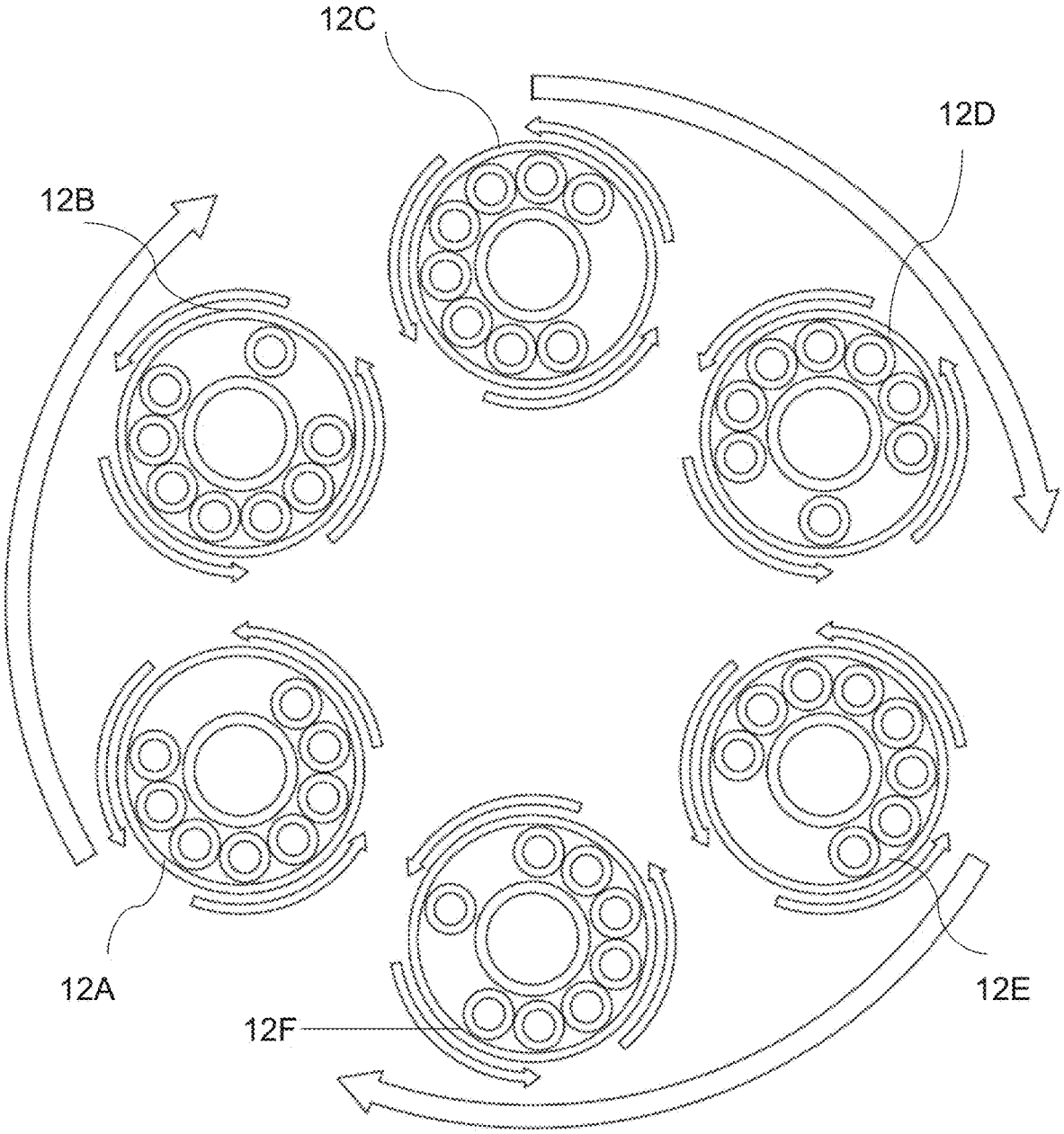
FIG. 12 is a drawing showing sequences of an exemplary container spinning in an exemplary dual asymmetrical centrifugal mixer, illustrating the rotation of the container in different positions and the shifting of position of the exemplary non-spherical grinding media resulting from the force applied by the dual asymmetrical centrifugal mixer.

Non-central units of grinding media may circulate in the space defined by the central unit of grinding media and the wall of the container. The non-central units of grinding media circulate around the central unit of grinding media and around the periphery of the container. The support from the wall of the container and the central unit of grinding media prevents the other units of grinding media from toppling over. The number of units of grinding media in the container is such that there is still sufficient space for the units of grinding media to circulate, once the dual asymmetric centrifuge begins to run in order to start the grinding. On the other hand, the number of units of grinding media in the container is sufficient to retain the central unit of grinding media in the center of the container. This number of units of grinding media may be determined, e.g., from the space occupied by the units of grinding media, including the central unit, e.g. when the dual asymmetric centrifugal mixer is at rest. For instance, a number of units of grinding media positioned around the central unit may be determined by adding sufficient non-central units of grinding media to obtain a single space 10 defined between two neighboring units of grinding media (i.e. where all of the non-central units of grinding media are touching the inner wall of the container and all of the other non-central units of grinding media are touching two neighboring non-central units) with a width that is the greatest possible while being less than the diameter 11 of the central unit 110A. For instance, if the diameter 11 of the central unit is of 5 cm, and the single space 10 between the two units of grinding media is 6 cm, adding an extra non-central unit of grinding media is preferable to prevent the central unit of grinding media from dislodging from the center. On the other hand, if the space 10 defined by the two neighboring units of grinding media is 1 cm, and the diameter 11 of the central unit is of 5 cm, it is preferable to remove at least one non-central unit of grinding media to increase mobility of the non-central units of grinding media, while retaining the central unit 110A of grinding media in the center position. For instance, FIG. 12 shows units of grinding media moving along a periphery of the container, around a central unit of grinding media (illustrated in this example as larger than the non-central units of grinding media), this movement resulting in one or more collisions or contact with other unit(s) of grinding media for grinding the one or more materials. The one or more units of grinding media travel as a function of the force applied by the dual asymmetric centrifuge mixer. The arrows indicate the direction of rotation. From 12A to 12C, the topmost unit of grinding media in 12A that is only in contact with one other non-central unit of grinding media travels around the central unit of grinding media to contact the oppositely positioned non-central unit of grinding media. From 12C to 12E, the lower non-central unit of grinding media that is only in contact with one other non-central unit of grinding media travels to contact the oppositely positioned non-central unit of grinding media. Similarly, from 12E to 12A, the topmost non-central unit of grinding media that is only in contact with one other non-central unit of grinding media travels to contact the oppositely positioned non-central unit of grinding media. The central unit of grinding media is maintained in the center of the container. The travelling of the non-central units of grinding media results in contact between the grinding media and collisions that grind the one or more materials.

The dual asymmetric centrifugal mixer applies a centrifugal force to the container 150 and to the contents of the container 150, including the non-spherical grinding media 110 and the one or more materials. The force causes the non-spherical grinding media 110 to move along the base of the container 150, colliding with the walls of the container 150 and with one another. The granules of the one or more materials may be trapped between the grinding media 110 and the wall of the container 150 or between two colliding units of non-spherical grinding media 110, the force of the collision causing the granule to break up into smaller parts.

Once the grinding has ended, and the size of the granules of the one or more materials has been sufficiently reduced, (when a lid 130 is present) the lid 130 is removed from the container 150, and the non-spherical grinding media 110 may be removed from the container 150 at step 950.

The ground materials are removed from the container 150 at step 960.

Steps 950 and 960 may occur simultaneously (e.g. a user emptying the entire contents of the container 150).

Although the invention has been described with reference to preferred embodiments, it is to be understood that modifications may be resorted to as will be apparent to those skilled in the art. Such modifications and variations are to be considered within the purview and scope of the present invention.

Representative, non-limiting examples of the present invention were described above in detail with reference to the attached drawing. This detailed description is merely intended to teach a person of skill in the art further details for practicing preferred aspects of the present teachings and is not intended to limit the scope of the invention. Furthermore, each of the additional features and teachings disclosed above and below may be utilized separately or in conjunction with other features and teachings.

Moreover, combinations of features and steps disclosed in the above detailed description, as well as in the experimental examples, may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

What is claimed is:

1. A method of grinding one or more materials using a dual asymmetric centrifugal mixer including a container comprising:

providing one or more units of non-spherical grinding media, wherein the one or more units of the non-spherical grinding media include a base and a top opposite from the base of the unit;

positioning in the container, through an opening of the container, the one or more units, the one or more units contacting a base of the container of the dual asymmetric centrifugal mixer the one or more units of non-spherical grinding media;

securing a lid to the opening of the container, wherein the one or more units of the non-spherical grinding media are prevented from toppling, where, once fallen over, a plane defined by a contact surface of the base of the fallen unit of the non-spherical grinding media is no longer parallel with a plane defined by the base of the container, by at least one of:

securing the lid sufficiently near the top of the one or more units of the non-spherical grinding media to prevent a tilting of the one or more units of non-spherical grinding media from toppling, the tilting unit of the non-spherical grinding media contacting the lid, the lid acting as an obstacle to the toppling; and the one or more units of the non-spherical grinding media have a shortest distance between a center of mass of the unit and the base of the unit that is less than half of a width of the base of the unit; and applying a centrifugal force to the container using the dual asymmetric centrifugal mixer, after the one or more materials to be ground is added to the container, the one or more units of non-spherical grinding media grinding the one or more materials when the container is subject to the centrifugal force applied by the dual asymmetric centrifugal mixer.

2. The method as defined in claim 1, wherein the height of the unit of one or more units of the non-spherical grinding media is less than the width of the base of the unit of the one or more units of non-spherical grinding media.

3. The method as defined in claim 1, wherein the one or more units of non-spherical grinding media have chamfered edges.

4. The method as defined in claim 1, wherein the one or more units of the non-spherical grinding media have a hollow interior.

5. The method as defined in claim 1, wherein the one or more units of the non-spherical grinding media have a solid interior.

6. The method as defined in claim 1, wherein the one or more units of the non-spherical grinding media have a cylindrical shape.

7. The method as defined in claim 1, wherein the one or more units of the non-spherical grinding media have a prism shape.

8. The method as defined in claim 1, wherein the one or more units of the non-spherical grinding media are rings with different diameters.

* * * * *